US010408004B2

(12) United States Patent
Tubel

(10) Patent No.: US 10,408,004 B2
(45) Date of Patent: Sep. 10, 2019

(54) SYSTEM FOR ACQUISITION OF WELLBORE PARAMETERS AND SHORT DISTANCE DATA TRANSFER

(71) Applicant: Tubel, LLC, The Woodlands, TX (US)

(72) Inventor: Paulo Tubel, The Woodlands, TX (US)

(73) Assignee: Tubel Energy LLC, The Woodlands, TX (US)

( * ) Notice: Subject to any disclaimer, the term of this patent is extended or adjusted under 35 U.S.C. 154(b) by 0 days.

(21) Appl. No.: 14/728,587

(22) Filed: Jun. 2, 2015

(65) Prior Publication Data

US 2016/0356150 A1 Dec. 8, 2016

(51) Int. Cl.

| | |
|---|---|
| ***E21B 23/02*** | (2006.01) |
| ***E21B 41/00*** | (2006.01) |
| ***E21B 47/01*** | (2012.01) |

(52) U.S. Cl.
CPC ..... *E21B 23/02* (2013.01); *E21B 41/0085* (2013.01); *E21B 47/011* (2013.01)

(58) Field of Classification Search
CPC ..... E21B 47/12; E21B 47/122
See application file for complete search history.

(56) References Cited

U.S. PATENT DOCUMENTS

2005/0046589 A1* 3/2005 Wisler ..... E21B 17/003 340/854.6
2006/0044156 A1* 3/2006 Adnan ..... E21B 47/12 340/854.9
2011/0138903 A1* 6/2011 Large ..... E21B 17/1021 73/152.17
2011/0199228 A1* 8/2011 Roddy ..... E21B 33/13 340/856.4
2011/0248566 A1* 10/2011 Purkis ..... E21B 33/0355 307/40
2013/0020065 A1* 1/2013 Tubel ..... E21B 34/066 166/66.4
2013/0128697 A1* 5/2013 Contant ..... E21B 17/028 367/81
2013/0257629 A1* 10/2013 Hallundbaek ..... E21B 47/122 340/854.6
2014/0218207 A1* 8/2014 Gano ..... H04B 5/0025 340/854.8
2014/0266210 A1* 9/2014 Godager ..... G01V 3/34 324/323
2015/0345281 A1* 12/2015 Cardellini ..... E21B 47/0006 340/853.2

(Continued)

*Primary Examiner* — Hirdepal Singh
(74) *Attorney, Agent, or Firm* — Maze IP Law, P.C.

(57) ABSTRACT

This system invention relates to the use of short hop communications to transfer data between 2 modules inside a well. A system deployed in a well permanently or semi-permanently collects data from downhole parameters such as pressure, temperature, vibration, flow and fluid identification and stores the information in the system memory. The receiver module is deployed in the well via slick line, electric line or coil tubing with the purpose of retrieving the data from the system memory by interfacing with the downhole module via wireless short hop communications. The receiver module can also send commands into the downhole module to change its data collection parameters. Upon completion of the data transfer, the collector is returned to the surface where the data is again wirelessly transferred to a processing system such as a Personal Computer.

8 Claims, 2 Drawing Sheets

(56) References Cited

U.S. PATENT DOCUMENTS

2015/0361787 A1* 12/2015 Taherian ..... E21B 47/122
340/854.6
2016/0084982 A1* 3/2016 Donderici ..... G01V 3/18
340/854.6
2016/0115782 A1* 4/2016 Martinez ..... E21B 47/12
340/853.3
2016/0194952 A1* 7/2016 Switzer ..... H04W 84/18
340/854.6
2016/0230505 A1* 8/2016 Garcia ..... E21B 23/01

* cited by examiner

SYSTEM FOR ACQUISITION OF WELLBORE PARAMETERS AND SHORT DISTANCE DATA TRANSFER

BACKGROUND OF THE INVENTION

Data acquisition in well during production and drilling have occurred for many years. In the production sector of the exploration and production of hydrocarbons, the use of downhole gauges for production and reservoir evaluation are done using permanent and retrievable systems.

The retrievable systems are normally deployed inside production tubing using an electrical cable that transmits information from the well in real time to the surface as the system is pulled from the bottom of the sell to the surface, logging the entire well for data.

There are also permanently deployed gauges and semi permanent gauges. The permanent gauges use a cable mounted on the outside of the production tubing from the surface to where the gauge is located in the well. The gauges transmit data in real time continuously. If the cable is cut then the gauge is no longer connected to the surface and no data is transferred to the surface. The cable deployment is also very complicated and can cause the customer to have to go in the well to fish the system if the cable is not flush to the production tubing.

There are semi permanent gauges where the system seats in a side pocket mandrel inside the well. The gauge collects data and stores the data in memory. When the operator wants data he retrieves the gauge from the well. The customer uses specialty equipment to retrieve and install the gauge. There is a potential for the gauge to fall from the retrieval equipment and go to the bottom of the well. Also the gauge may not come out of the side pocket gauge.

A new system where the gauge does not to need to be retrieved from downhole and does not use downhole cables has been developed to decrease potential failures due to cut cables and complications in retrieving gauges from downhole.

SUMMARY

A first aspect of an embodiment the system disclosed comprises a downhole module deployed in a wellbore. The downhole module comprises a protective housing adapted to well conditions, a power source, at least one sensor to collect desired data downhole such as borehole and production parameters, downhole electronics for communication, storing and transmitting data, and an antenna or other means to facilitate the wireless transfer of data.

A second aspect of an embodiment of the system disclosed comprises a receiver module capable of being deployed in the wellbore, and adapted to communicate with the downhole module wirelessly. The receiver module comprises a receiver housing also adapted to well conditions, a receiver power source, and receiver electronics. The receiver electronics facilitates communication, and storing and transmitting data wirelessly between the downhole module and the receiver module utilizing a receiver transceiver, and a receiver data storage medium adapted to store and transmit data. The receiver module further comprises a receiver antenna or other means to facilitate wireless data transfer between the receiver and downhole modules. In such an embodiment, the receiver antenna and the downhole module antenna would be operatively in communication with their respective transceivers to accomplish the wireless transfer of data. The receiver module could be deployed in the wellbore through casing or through tubing.

In one embodiment of the system, multiple downhole modules can be deployed downhole with the capability of communicating data between downhole modules via short distance wireless data transfer, as well as between downhole modules and the receiver module. Downhole modules could be arranged in such a manner as to provide real time data through the wireless transfer of data along a string of downhole modules. In such an embodiment, data could be collected at the surface from the downhole module via a cable or receiver module. Downhole modules can be deployed as part of the tubing string, casing string or through tubing in a wellbore. The communications can be between a module in the casing to the module in the tubing, multiple modules in the casing or tubing and between modules in the casing or tubing and a through tubing module deployed in the well via electric line, coil tubing, slick line or pipe conveyed.

In another embodiment of the system, the downhole sensor or sensors comprise at least one of a pressure or temperature sensor for measuring borehole or production parameters.

In a further embodiment of the system, the downhole and receiver modules power sources could comprise batteries, other means of generating power such as through the use of magnetic, acoustic, or vibrational energy, any other means of harvesting energy downhole, or by an energetic cable. In another embodiment, the downhole module could be recharged or otherwise powered by means of wireless power transfer from the receiver module. Such means of transferring power from the receiver module to the downhole module could include magnetically generated energy, acoustic energy, or any other form of wireless energy.

In a further embodiment of the system, a latch assembly is used to facilitate positioning the receiver module near the downhole module. In such an embodiment, the latch assembly comprises latch housing, and a spring loaded assembly embedded within the housing with at least one angular protrusion intended to cause resistance when encountering a groove within the downhole module housing. The latch assembly in such an embodiment would further comprise a connection to the receiver module.

In a further embodiment of the system, modules can communicate using electromagnetic waves, acoustic, compressional, or shear waves, pressure pulses, or other means of communications between the modules.

While preferred aspects and embodiments of the system are shown and described herein, it will be understood that the invention may be embodied otherwise than herein specifically illustrated or described, and that certain changes in form and arrangement of parts and the specific manner of practicing the system may be made within the underlying idea or principles of the system.

BRIEF DESCRIPTION OF THE DRAWINGS

These and other features, aspects, and advantages of the system will become better understood with regard to the follow description, appended claims, and accompanying drawings where:

The various drawings supplied herein are representative of one or more embodiments of the present invention.

DESCRIPTION OF EMBODIMENTS

In the Summary above and in the Description of Embodiments, and the claims below, and in the accompanying drawings, reference is made to particular features of the system. It is to be understood that the disclosure of the system in this specification includes all possible combinations of such particular features. For example, where a particular feature is disclosed in the context of a particular aspect or embodiment of the system, or a particular claim, that feature can also be used, to the extent possible, in combination with and/or in the context of other particular aspects and embodiments of the system, and in the system generally.

Figure 1:
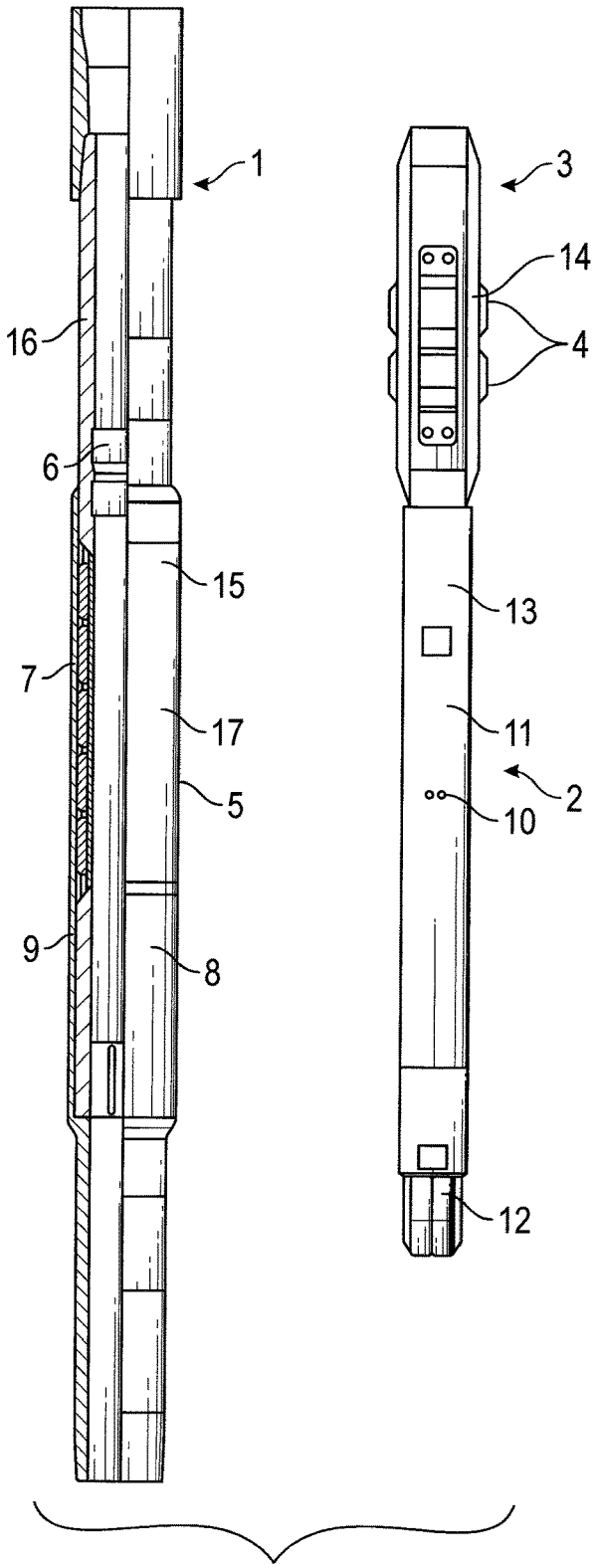
FIG. 1 shows a partial cutaway of an exemplary embodiment of a downhole module and an exemplary embodiment of a receiver module.

Referring now to FIG. 1, exemplary embodiments of a downhole module 1 and a receiver module 2 of an embodiment of the system are shown. FIG. 1 shows a partial cutaway of downhole module 1, displaying the interior of the downhole module 16, as well as the exterior of the downhole module 17. The downhole module 1 of the system is designed to be deployed downhole utilizing a housing 5. Housing 5 is designed to be deployed downhole along a casing string, tubing string, or through tubing, and provides protection and a framework for downhole module 1.

Referring additionally to FIG. 1, power source 7 utilizes batteries to power downhole module 1. In a preferred embodiment of the system, batteries utilized by power source 7 are rechargeable. In other embodiments of the system, power source 7 could utilize electromagnetic, acoustic, magnetic, or vibrational energy to power downhole module 1. In an additional embodiment of the system, power source 7 powers downhole module 1 by harvesting any source of energy downhole. Any source of energy that can be converted into electrical energy could be utilized by power source 7 to provide power to downhole module 1.

Still referring to FIG. 1, sensor or sensors 8 are disposed at least partially within housing 5, and collect desired data, such as borehole or production parameters, utilizing at least one sensor. Such sensor or sensors could include pressure, fluid identification, or temperature sensors.

In a preferred embodiment, data collected downhole by at least one sensor 8 is transmitted to downhole electronics 9 from the sensor or sensors 8, where the data is stored by the data storage medium of the downhole electronics 9 utilizing any desired digital data storage method. In a preferred embodiment, the data storage medium of downhole electronics 9 utilizes flash memory to store data. Downhole electronics 9 further comprises a transceiver to enable communication for purposes including transmitting to and receiving data from receiver module 2. Antenna 15 is at least partially embedded in downhole module 1, and facilitates such communication by providing the means for wireless communication. When the downhole module 1 sends data, the data is sent from downhole electronics 9 from the data storage medium, and through the transceiver, to the antenna 15 for broadcasting.

Further referring to FIG. 1, in a preferred embodiment, receiver module 2 comprises a receiver housing 11 adapted to be deployed downhole. Receiver housing 11 further provides protection and a framework for receiver module 2. Receiver power source 13 is within receiver housing 11 and, in a preferred embodiment, comprises batteries or an energetic cable.

Receiver module 2 further comprises receiver electronics 10 at least partially disposed within receiver housing 11. The receiver electronics 10, in preferred embodiments, facilitates and controls communications, and further comprises a receiver transceiver, and a receiver data storage medium that can store and transmit data. The receiver data storage medium could utilize any desired means for storing digital data, including flash memory. Receiver antenna assembly 12 enables wireless communications, facilitating short hop data transfer between the downhole module 1 and the receiver module 2, and is operatively in communication with the receiver transceiver.

Figure 2:
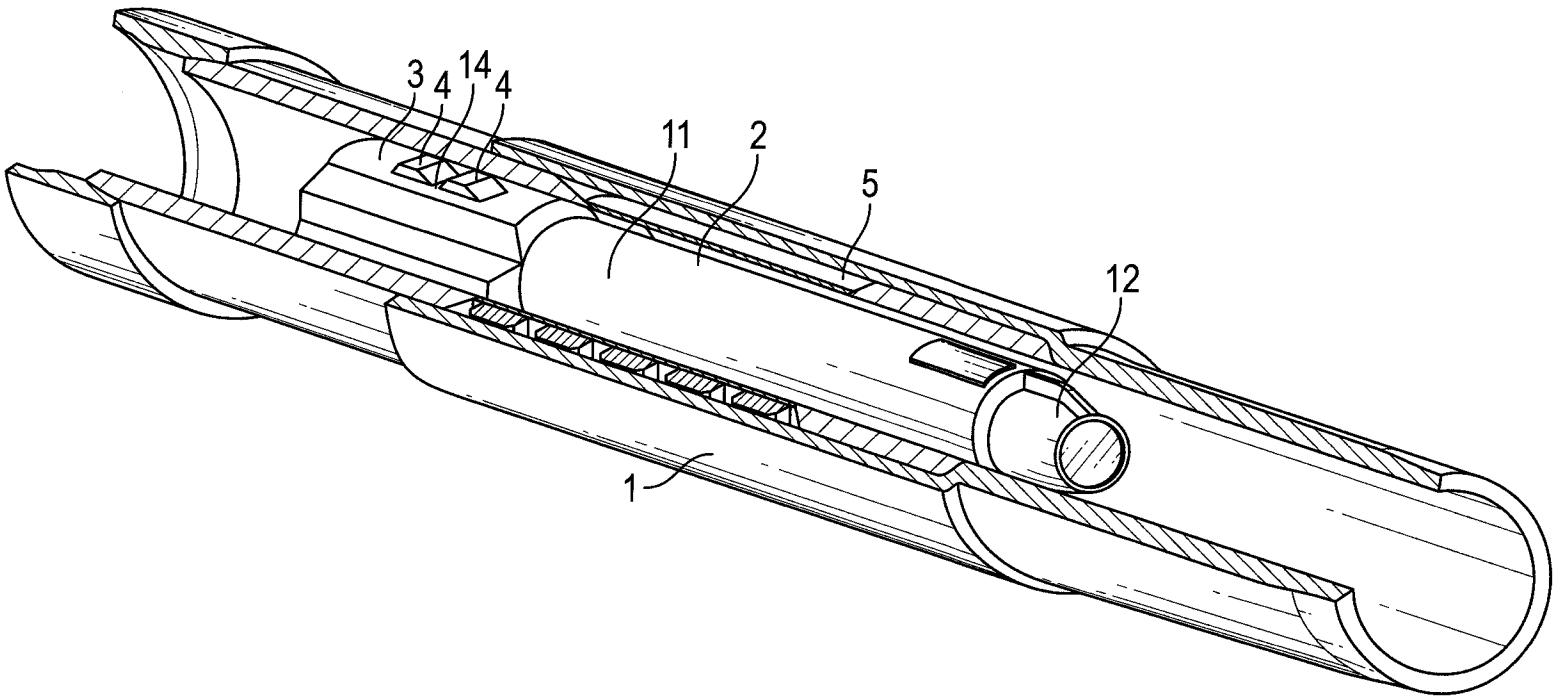
FIG. 2 shows a representative system wherein an exemplary receiver module is positioned to collect data from an exemplary downhole module deployed downhole.

When data is collected from the downhole module 1, receiver module 2 is deployed inside the casing or tubing, as exemplified in FIG. 2, to retrieve data from the downhole module. Referring now to both FIG. 1 and FIG. 2, in a preferred embodiment of the system, the receiver module 2 further comprises a latch assembly 3. The latch assembly 3 facilitates putting the receiver module 2 in a well such that the receiver module 2 is positioned at a desired distance from the downhole module 1 to enable wireless communication between the receiver module 2 and the downhole module 1.

In such an embodiment comprising latch assembly 3, the latch assembly 3 connects to the receiver module 2 via a connection, and comprises at least one angular protrusion 4, on it spring assisted assembly 14, which creates resistance when encountering the discriminating latch profile 6 of the downhole module. The discriminating latch profile 6, in a preferred embodiment, comprises at least one groove around the interior of the downhole module housing 5 which catches the angular protrusion 4, thereby creating resistance that can be detected by the operator. Such resistance indicates that the receiver module 2 is positioned as desired for wireless communication with the downhole module 1. The spring assisted assembly 14 allows the receiver module 2 to continue movement through the casing or tubing, or otherwise be removed from the well, by allowing the angular protrusion 4 to recede into the receiver housing 11 when encountering the discriminating latch profile 6, thereby creating resistance that can be detected by the operator, but still allowing the receiver module 2 to continue movement through the casing or tubing as desired.

In embodiments that do not include the latch module 3 and corresponding discriminating latch profile 6, the receiver module 2 is deployed on an electric line with a casing collar locator, thereby allowing an operator to determine the location of the receiver module 2 and position receiver module 2 within the well as desired for wireless communication with the downhole module 1.

Still referring to both FIG. 1 and FIG. 2, in a preferred embodiment of the system, when the receiver module 2 is positioned as desired relative to the downhole module 1, data is transferred from the downhole electronics 9 to the antenna 15, which wirelessly transmits desired data from the downhole module 1. The data transmitted from antenna 15 is then received by the receiver module 2 with the receiver antenna assembly 12, at which time the data is transmitted to the receiver electronics 10 through the receiver transceiver and then stored by the receiver data storage medium. Data can also be transmitted similarly from the receiver module 2 to the downhole module 1, as preferred embodiments of the system provide for two-way communication. Receiver module 2 can be retrieved from the well by the operator to provide acquired data to the surface.

In an embodiment of the system, multiple downhole modules 1 could be deployed along a casing or tubing string, creating a chain of downhole modules 1 such that the antenna 15 of one downhole module 1 could communicate data to another downhole module 1 where the data is received via another antenna 15. The data could then be transmitted along the chain of downhole modules 1, all the way to the surface if desired, thereby enabling real time communication of data. Data could be retrieved at the surface via the deployment of receiver module 2, or by a cable when the downhole module 1 further comprises a cable interface assembly.

In another embodiment of the system, the receiver module 2 could be used to provide power wirelessly to the downhole module 2 through the use of electromagnetic, magnetic, or other means of wireless power transfer. In an exemplary embodiment, power could be transferred from the receiver power source 13, or other source of power on the receiver module 2, to the power source 7 of downhole module 1 via the broadcast and corresponding receiving of electromagnetic energy which is then converted to electrical energy. In another exemplary embodiment, electrical energy could be created for the downhole module 1 through the disturbance of a magnetic field by the receiver module 2.

The invention claimed is:

1. A system for data acquisition and short distance wireless data transfer between wellbore modules comprising:

a. a downhole module, comprising;
  i. a downhole module power source;
  ii. a data acquisition sensor operatively connected to the downhole module power source;
  iii. downhole electronics operatively connected to the downhole module power source, the downhole electronics operatively in communication with the sensor, the downhole electronics further comprising;
    1. a transceiver; and
    2. a data storage medium; and
  iv. a discriminating latch profile;
  v. a short distance wireless data communication antenna operatively in communication with the transceiver; and a. a separate receiver module sized to be removably deployable within the well bore, the separate receiver module comprising:
  vi. a receiver power source;
  vii. receiver electronics operatively connected to the receiver power source, the receiver electronics further comprising:
    3. a receiver transceiver; and
    4. a receiver data storage medium operatively in communication with the receiver electronics;
  viii. a wireless data communications receiver antenna operatively in communication with the receiver transceiver; and
  ix. a latch assembly configured to cooperatively interface with the discriminating latch profile, the latch assembly comprising:
    1. a latch housing; and
    2. a spring assisted assembly comprising at least one angular protrusion.

2. The system of claim 1 wherein the downhole module and the receiver module communicate using electromagnetic waves, acoustic compressional or shear waves, or pressure pulses.

3. The system of claim 1 wherein the sensor further comprises a sensor borehole pressure sensor, a borehole temperature sensor, a borehole fluid identification sensor, a borehole fluid flow sensor.

4. A method of gathering data from a wellbore using a system for data acquisition and short distance wireless data transfer between wellbore modules comprising a downhole module comprising a protective housing deployable within a well bore, a power source disposed within the housing, a data acquisition sensor disposed at least partially within the housing and operatively connected to the power source, downhole electronics operatively connected to the power source, disposed within the housing, and operatively in communication with the sensor where the downhole electronics further comprises a transceiver and a data storage medium, and a short distance wireless data communications antenna operatively in communication with the transceiver and a separate receiver module comprising a protective receiver housing sized to be deployable within the well bore, a receiver power source disposed within the receiver housing, receiver electronics operatively connected to the receiver power source and at least partially disposed within the receiver housing where the receiver electronics further comprises a receiver transceiver and a receiver data storage medium operatively in communication with the receiver electronics, and a wireless data communications receiver antenna operatively in communication with the receiver transceiver, the method comprising:

a. retrieving data from the downhole module by the receiver module;
b. deploying the downhole module downhole where the housing is sized to be deployed downhole along a casing string, tubing string, or through tubing, the downhole module housing further configured to provide protection for components disposed in the downhole module housing and a framework for the downhole module;
c. supplying power to the downhole module via its power source;
d. using the sensor to collect desired data;
e. transmitting data collected downhole by the sensor to the downhole electronics;
f. storing the data in the data storage medium;
g. deploying the receiver module in the wellbore; and
h. using the downhole module transceiver to wirelessly transmit data to and receive data from the receiver module.

5. The method of claim 4, further comprising a. using a receiver module comprising a latch assembly; and
b. using the latch assembly to releasably anchor the receiver module in the well such that the receiver module is positioned at a desired distance from the downhole module to enable wireless communication between the receiver module and the downhole module.

6. The method of claim 4, wherein the receiver module is deployed on an electric line with a casing collar locator, thereby allowing an operator to determine the location of the receiver module and position receiver module within the wellbore as desired for wireless communication with the downhole module.

7. The method of claim 4, further comprising retrieving the receiver module from the wellbore by an operator to provide acquired data to the surface.

8. The method of claim 4, further comprising deploying a plurality of downhole modules along a casing or tubing string, creating a chain of downhole modules such that the antenna of one downhole module of the plurality of downhole modules is configured to allow communication of data to another downhole module of the plurality of downhole modules where the data are received via the other downhole module's antenna, thus allowing data to be transmitted along a chain of downhole modules such that communications occurs between a downhole module in the casing string to a receiver module in the tubing, between multiple downhole and receiver modules in the casing string or tubing, or between downhole and receiver modules in the casing string or tubing and a through tubing module deployed in the well.

* * * * *